US012637870B2

(12) United States Patent
Zeng et al.

(10) Patent No.: US 12,637,870 B2
(45) Date of Patent: May 26, 2026

(54) INFLATABLE POOL

(71) Applicant: BESTWAY INFLATABLES & MATERIAL CORP., Shanghai (CN)

(72) Inventors: Xianglin Zeng, Shanghai (CN); Qingshui Song, Shanghai (CN); Yunzhe Ban, Shanghai (CN); Chenggen Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 300 days.

(21) Appl. No.: 18/243,895

(22) Filed: Sep. 8, 2023

(65) Prior Publication Data

US 2024/0337122 A1 Oct. 10, 2024

(30) Foreign Application Priority Data

Apr. 6, 2023 (CN) ..... 202320761778.9

(51) Int. Cl.
*E04H 4/00* (2006.01)

(52) U.S. Cl.
CPC ..... *E04H 4/0025* (2013.01)

(58) Field of Classification Search
CPC ..... E04H 4/0025
USPC ..... 4/488, 191; 482/55; 52/169.7, 741.11
See application file for complete search history.

(56) References Cited

U.S. PATENT DOCUMENTS 4,170,799 A * 10/1979 Ratelband ..... A63B 69/12 434/254
4,335,473 A * 6/1982 de Pous ..... E04H 4/0025 4/584
4,597,113 A * 7/1986 Eymard ..... E04H 4/0025 4/488
4,935,970 A * 6/1990 Aristone ..... E04H 4/0025 D30/129
5,924,144 A * 7/1999 Peterson ..... E04H 4/0025 4/488
5,987,661 A * 11/1999 Peterson ..... E04H 4/0025 4/488
6,062,983 A * 5/2000 Butsook ..... A63G 21/18 4/488
6,595,861 B1 * 7/2003 Morrow ..... E04H 4/0025 4/488

(Continued)

FOREIGN PATENT DOCUMENTS

CN 207568250 U * 7/2018 ..... E04H 4/0025
CN 111576946 A * 8/2020 ..... E04H 4/0025

(Continued)

OTHER PUBLICATIONS

Extended European Search Report dated Apr. 2, 2024 (Apr. 2, 2024), 24 pages, issued on related European Patent Application 23203575.8 by the European Patent Office.

*Primary Examiner* — Lori L Baker
(74) *Attorney, Agent, or Firm* — Dickinson Wright PLLC

(57) ABSTRACT

An inflatable pool includes a bottom wall and a side wall, together defining a water cavity. The side wall includes an inner side wall having a lower edge welded to the bottom wall, forming an annular weld; an outer side wall surrounding the inner side wall, and a top wall. The inner side wall, the outer side wall, and the top wall together define an inflatable chamber therein. The annular weld includes at least one arched weld segment projecting toward the outer side wall.

18 Claims, 18 Drawing Sheets

(56) References Cited

U.S. PATENT DOCUMENTS

| | | | | |
|---|---|---|---|---|
| 7,218,235 | B1 * | 5/2007 | Rainey | G08B 21/086 4/488 |
| 7,308,989 | B2 * | 12/2007 | Zheng | E04H 15/40 220/666 |
| 7,699,186 | B2 * | 4/2010 | Zheng | E04H 4/0025 4/488 |
| 2005/0159275 | A1 * | 7/2005 | Bullman | A63B 69/0035 482/111 |
| 2010/0009813 | A1 * | 1/2010 | Mayaud | E04H 4/0025 482/55 |
| 2014/0059760 | A1 | 3/2014 | Hendrick | |
| 2016/0102470 | A1 | 4/2016 | Brooks et al. | |
| 2019/0085576 | A1 * | 3/2019 | Lin | A61H 33/0095 |
| 2019/0161986 | A1 * | 5/2019 | Huang | E04H 4/0025 |
| 2020/0347628 | A9 * | 11/2020 | Lin | A61H 33/6005 |
| 2022/0325546 | A1 * | 10/2022 | Lin | A61H 33/026 |
| 2023/0381063 | A1 * | 11/2023 | Huang | A61H 33/02 |
| 2024/0003152 | A1 * | 1/2024 | Zeng | A61H 33/0087 |

FOREIGN PATENT DOCUMENTS

| | | | | | |
|---|---|---|---|---|---|
| CN | 111764707 | | | 10/2020 | |
| CN | 213269138 | U | * | 5/2021 | E04H 4/1245 |
| CN | 214463007 | U | * | 10/2021 | E04H 4/0025 |
| CN | 216866153 | | | 7/2022 | |
| CN | 216866153 | U | * | 7/2022 | |
| CN | 220725888 | U | * | 4/2024 | E04H 4/103 |
| EP | 4039915 | A1 | * | 8/2022 | E04H 4/0025 |
| EP | 4528050 | A1 | * | 3/2025 | E04H 4/0025 |
| WO | WO-2015085227 | A1 | * | 6/2015 | A61H 33/6005 |

* cited by examiner

INFLATABLE POOL

CROSS-REFERENCE TO RELATED APPLICATION

This application claims priority from Chinese Application CN 202320761778.9, filed Apr. 6, 2023 in China, the disclosure of which is incorporated herein by reference in its entirety.

BACKGROUND

1. Field

Example embodiments relate to inflatable pools, and in particular to a tear-proof inflatable pool.

2. Description of Related Art

An inflatable pool is a recreational product gaining in popularity. Inflatable pools, which are plastic products, are often made by joining pieces through welding during the production process, which is known for its simplicity and high reliability. However, tearing is a common form of damage that occurs during the use of inflatable pools. Tearing mainly occurs at stress concentration points or weak points in the structural design of an inflatable pool, such as at certain points along an annular weld between the inner side wall and bottom wall of an inflatable pool. Some of these points may be subject to high hydrostatic pressure due to the structural design, while others are located in complex welding positions with weaker connection strength. Furthermore, the strength of connections at positions that have been welded multiple times is slightly weaker than those welded once. During use, these positions that have been welded multiple times are more prone to tearing and air leaks when subject to the pressure of the water in the pool for a prolonged period of time.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable pool comprises: a bottom wall and a side wall, the bottom wall and side wall together defining a water cavity; wherein the side wall comprises: an inner side wall comprising a lower edge welded to the bottom wall, thereby forming an annular weld, an outer side wall surrounding the inner side wall, and a top wall, wherein the annular weld comprises at least one arched weld segment projecting toward the outer side wall.

The inner side wall may comprise an inner wall splice sheet comprising a first end welded to a second end thereby forming a first weld which intersects the arched weld segment.

The bottom wall may comprise a first bottom splice sheet welded to a second bottom splice sheet, thereby forming a second weld is formed, the second weld which intersects the arched weld segment.

The inflatable pool may further comprise a reinforcing strip disposed at the arched weld segment and connecting the inner side wall and the bottom wall.

The reinforcing strip may completely cover the arched weld segment and may be attached to each of the inner side wall and the bottom wall.

The top wall may be annular and comprise an arcuate segment curved toward an inside of the water cavity.

The top wall may comprise at least two top splice sheets joined end-to-end, each of the at least two splice sheets forming an arcuate segment.

An inflatable chamber may be is jointly defined by the inner side wall, the outer side wall, the top wall, and the bottom wall, wherein the inflatable pool further comprises a plurality of tensioning members are disposed within the inflatable chamber, wherein each of the plurality of tensioning members is connected to the inner side wall and the outer side wall.

The inflatable pool may further comprise: a cushion layer, and a mat layer, wherein a periphery of the mat layer is connected to the bottom wall, and the cushion layer is sandwiched between the mat layer and the bottom wall.

The cushion layer may be made of one of expanded polyethylene foam and polyester fiberfill.

According to an aspect of another example embodiment, an inflatable pool may comprise: a bottom wall comprising a first bottom splice sheet and a second bottom splice sheet welded to the first splice sheet; an side wall, wherein the bottom wall and the side wall together define a water cavity; wherein the side wall comprises: an inner side wall comprising a lower edge welded to the bottom wall, thereby forming an annular weld comprising: a first arched weld segment projecting outwardly and intersecting a weld between the first bottom splice sheet and the second bottom splice sheet, and a second arched weld segment projecting outwardly and intersecting the weld between the first bottom splice sheet and the second bottom splice sheet, an outer side wall surrounding the inner side wall, and an annular top wall, wherein the inner side wall, the outer side wall, and the annular top wall together define an inflatable chamber therein The inflatable pool may further comprise: a plurality of tensioning members disposed within the inflatable chamber, wherein each of the plurality of tensioning members has a first side connected to the inner side wall and a second side connected to the outer side wall.

The inflatable pool may further comprise: a first reinforcing strip connecting the inner side wall and the bottom wall at the first arched weld segment, and a second reinforcing strip connecting the inner side wall and the bottom wall at the second arched weld segment.

The inner side wall may comprise: a first inner wall splice sheet and a second inner wall splice sheet; wherein a first end of the first inner wall splice sheet is welded to a second end of the second inner wall splice sheet, thereby forming a first side wall weld which intersects the first arched weld segment; and wherein a second end of the first inner wall splice sheet is welded to a first end of the second inner wall splice sheet, thereby forming a second side wall weld which intersects the second arched weld segment.

The inflatable pool may further comprise: a mat layer, wherein a periphery of the mat layer is welded to the bottom wall; and a cushion layer disposed between the mat layer and the bottom wall.

The cushion may be made of one of expanded polyethylene foam and polyester fiberfill.

BRIEF DESCRIPTION OF THE DRAWINGS

The above and/or other aspects will become apparent and more readily appreciated from the following description of example embodiments, taken in conjunction with the accompanying drawings, in which: Other features and advantages of the present utility model will be better understood through the following optional embodiments described in details with reference to the accompanying drawings. Like or similar components are denoted by like reference numerals in the accompanying drawings, in which.

DETAILED DESCRIPTION

Figure 1:
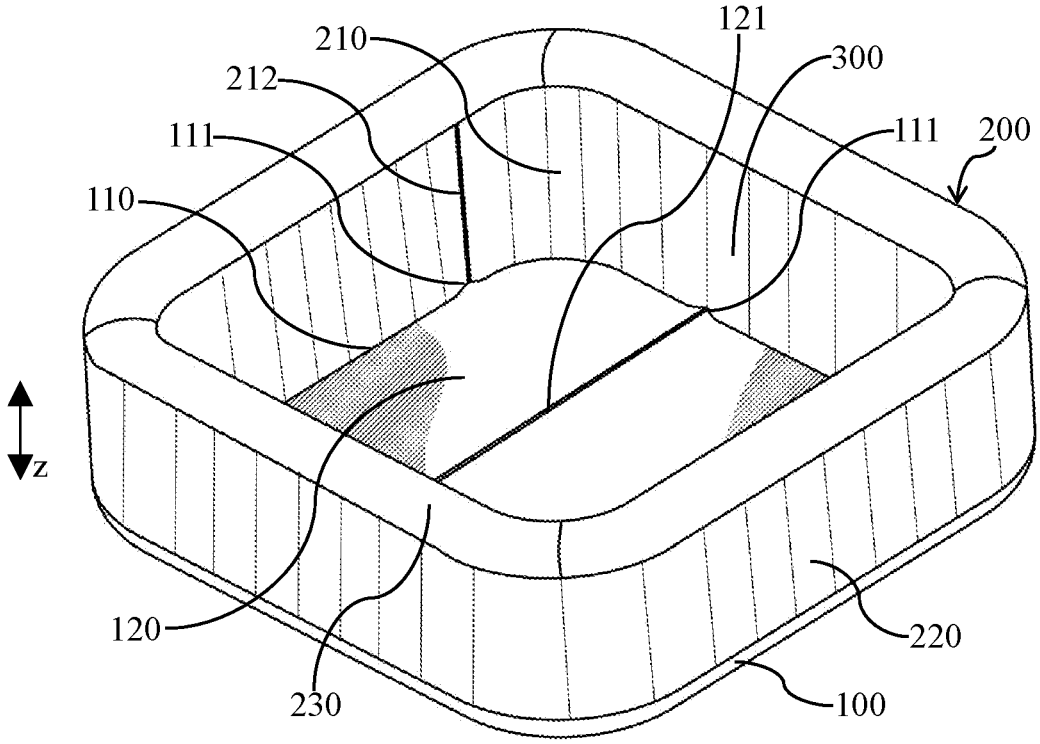
FIG. 1 is a schematic diagram of an inflatable pool according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

Figure 2:
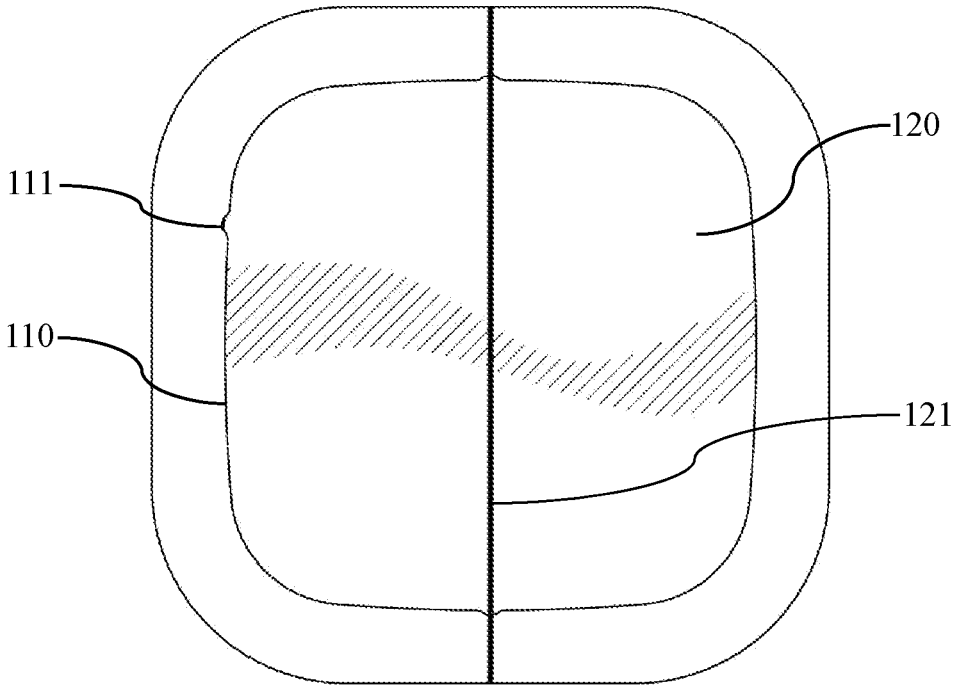
FIG. 2 is a top view of the inflatable pool shown in FIG. 1 taken along a plane of the bottom wall.
Figure 3:
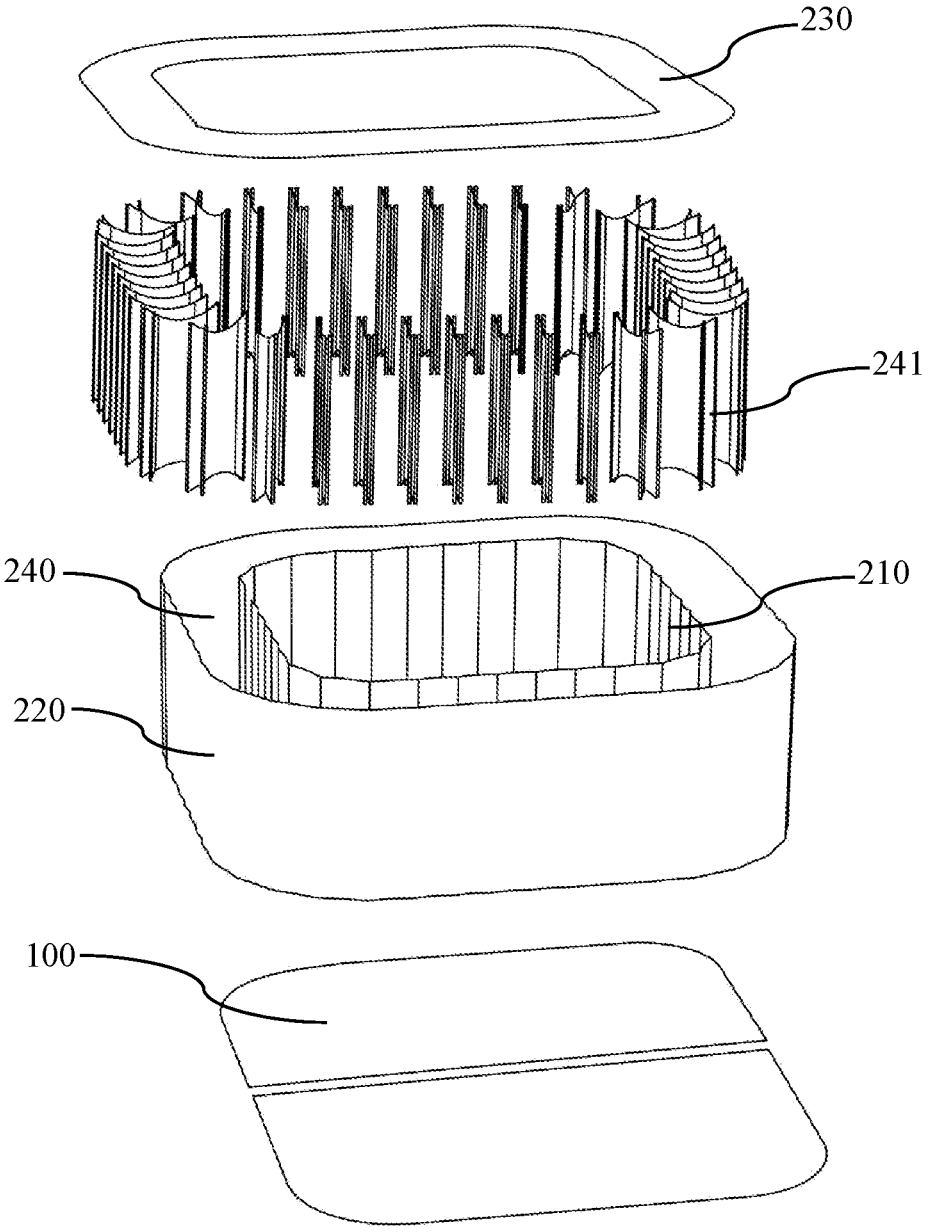
FIG. 3 is an exploded view of the inflatable pool shown in FIG. 1.
Figure 4:
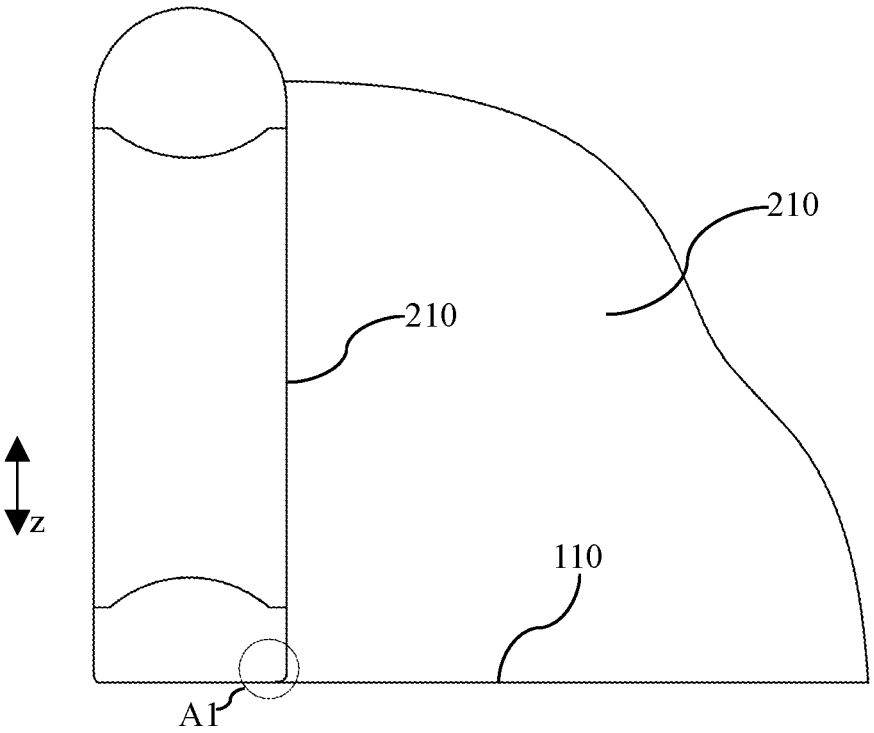
FIG. 4 is a partial cross-sectional view of an inflatable pool showing an arched weld segment including an inner side wall and a bottom wall of an example embodiment.
Figure 5:
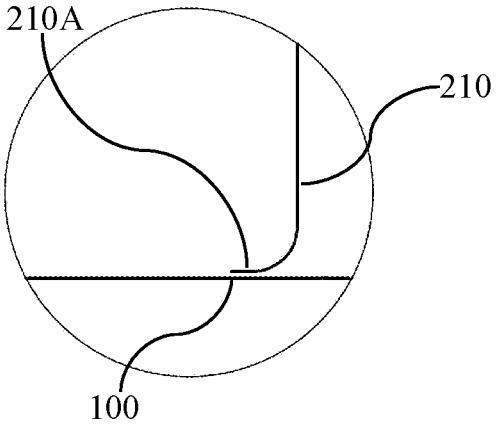
FIG. 5 is an enlarged schematic view of the area indicated by A1 in FIG. 4.
Figure 6:
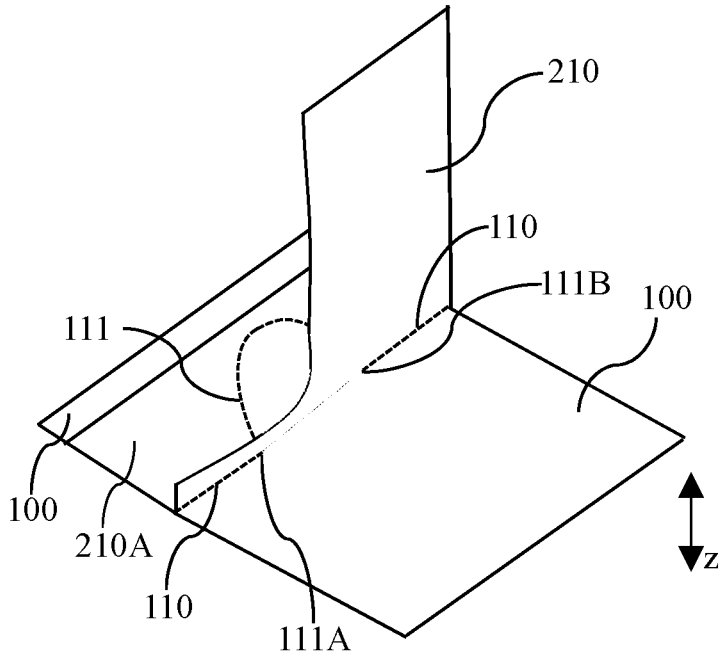
FIG. 6 is a schematic perspective view of an example structure shown in FIG. 5.
Figure 7:
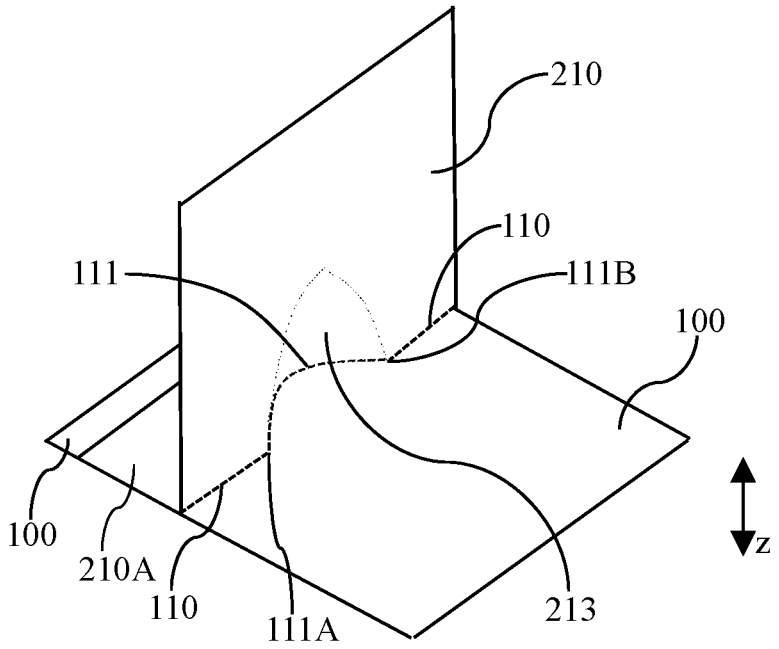
FIG. 7 is a schematic perspective view of another example structure shown in FIG.

Referring to FIGS. 1 to 3, an inflatable pool includes a bottom wall 100 and an side wall 200. The side wall 200 includes an inner side wall 210, an outer side wall 220, and a top wall 230. The outer side wall 220 surrounds the outer side of the inner side wall 210. Lower edges of the inner side wall 210 and the outer side wall 220 are both connected to the bottom wall 100, while upper edges of the inner side wall 210 and the outer side wall 220 are both connected to the top wall 230. The inner side wall 210, the outer side wall 220, the top wall 230 and the bottom wall 100 collectively define an inflatable chamber 240 of the inflatable pool. The bottom wall 100 and the side wall 200 together define a water cavity 300 operable to contain water, and specifically, the bottom wall 100 and the inner side wall 210 of the side wall 200 together define the water cavity 300. A lower edge 210A of the inner side wall 210 is welded to the bottom wall 100, forming an annular weld 110. The annular weld 110 has at least one arched weld segment 111 projecting toward the outer side wall 220. FIG. 2 shows an example annular weld 110 and an arched weld segment 111 of an example embodiment.

According to one or more example embodiments, as shown in FIGS. 4 to 7, one or more portions of the annular weld 110 project toward the outer side wall 220 to form the arched weld segment(s) 111. For clarity and distinction, the welds (including the annular weld 110, a first weld 212, and a second weld 121, which will be mentioned below) and the arched weld segment 111 are indicated by a single dashed line in the accompanying drawings, as described herein.

Figure 8:
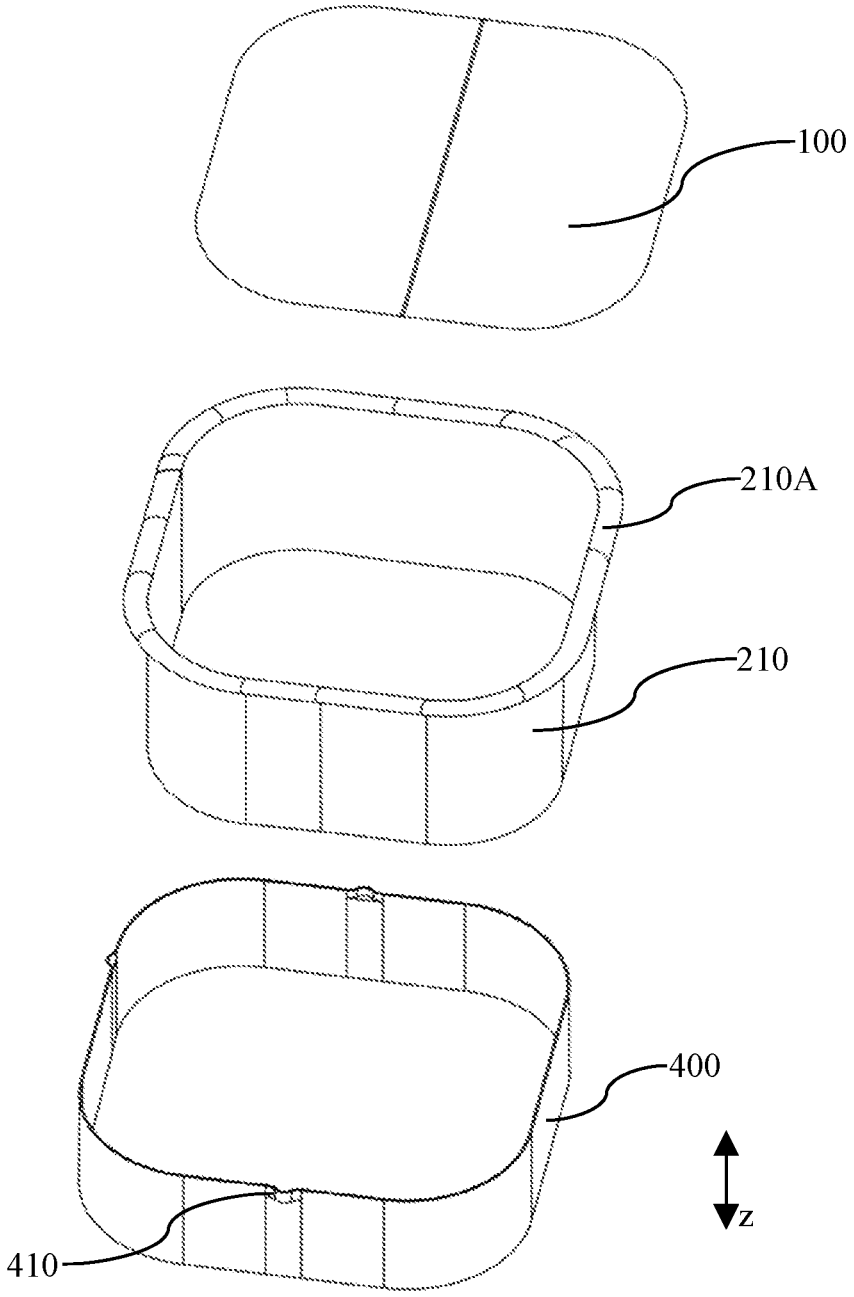
FIG. 8 is a schematic diagram of an example structure at an arched weld segment.
Figure 9:
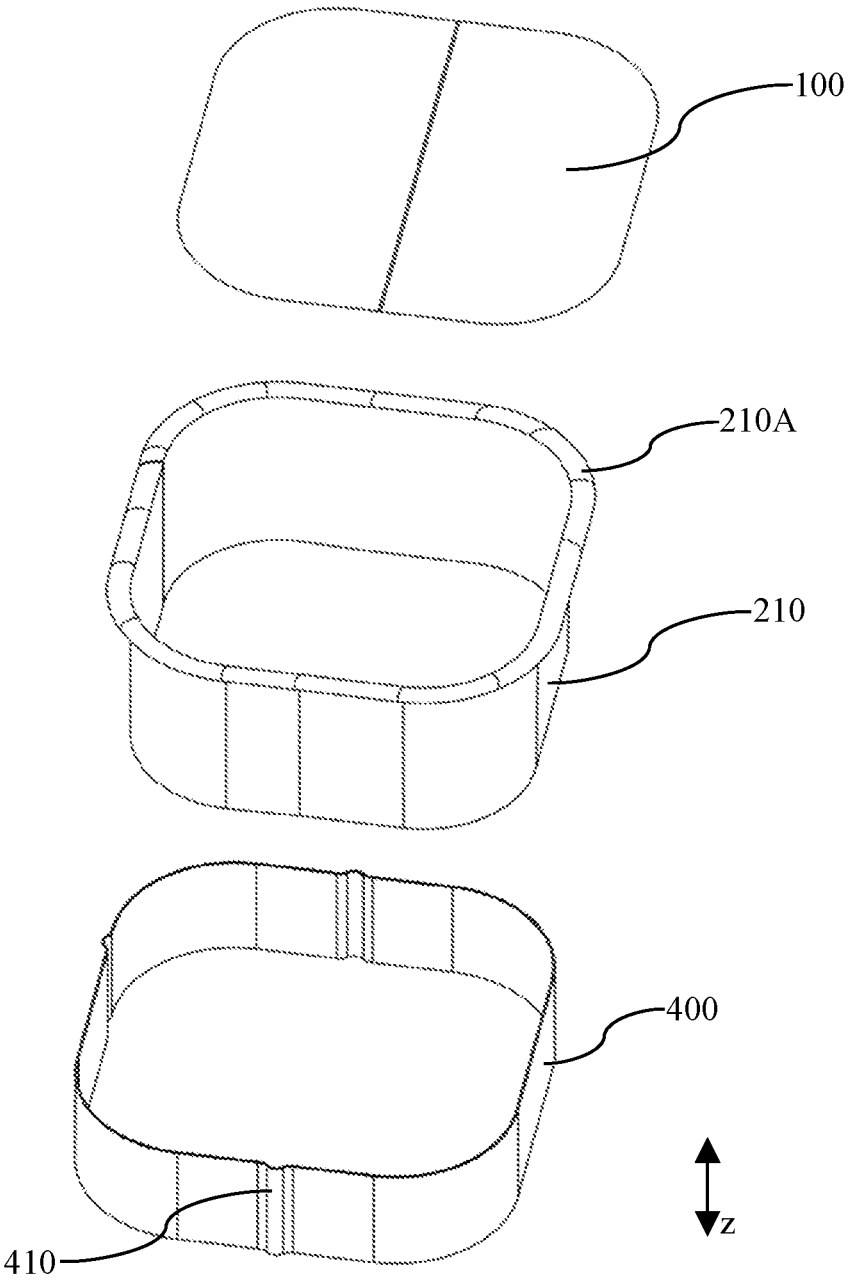
FIG. 9 is a schematic diagram of another example structure at an arched weld segment.
Figure 10:
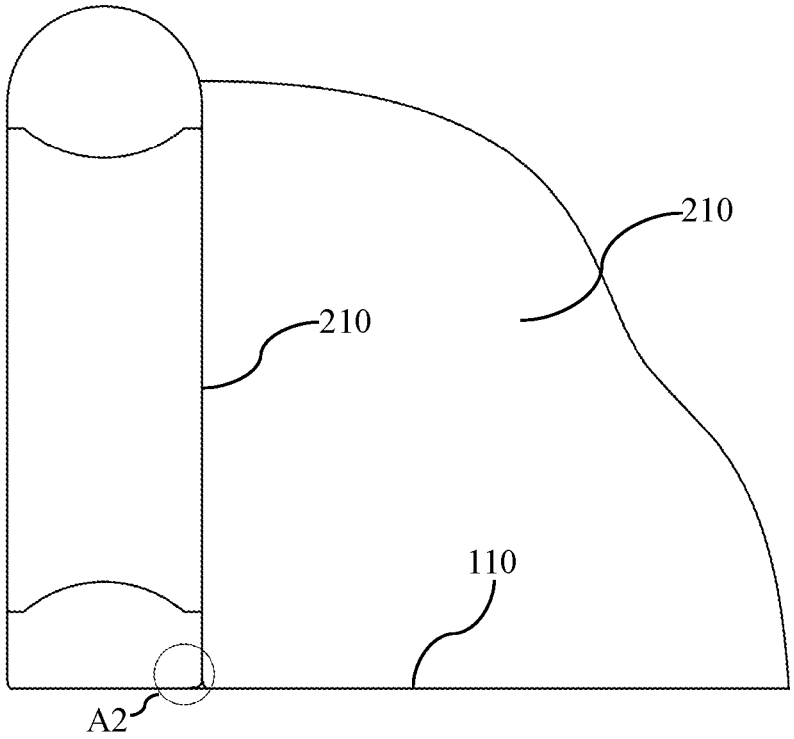
FIG. 10 is a partial cross-sectional view similar to FIG. 4, showing an addition of a reinforcing strip according to an example embodiment.
Figure 11:
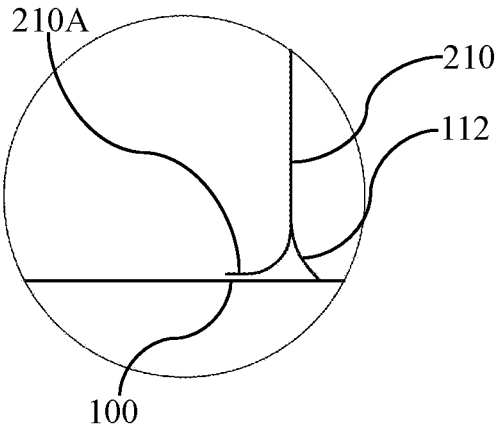
FIG. 11 is an enlarged schematic view of the area indicated by A2 in FIG. 10.
Figure 12:
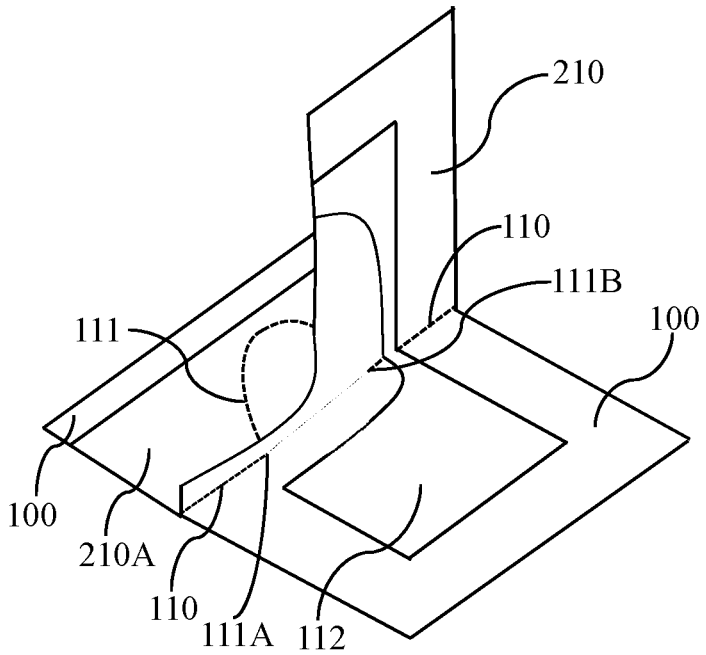
FIG. 12 is a schematic perspective view of an example of the structure shown in FIG. 11.
Figure 13:
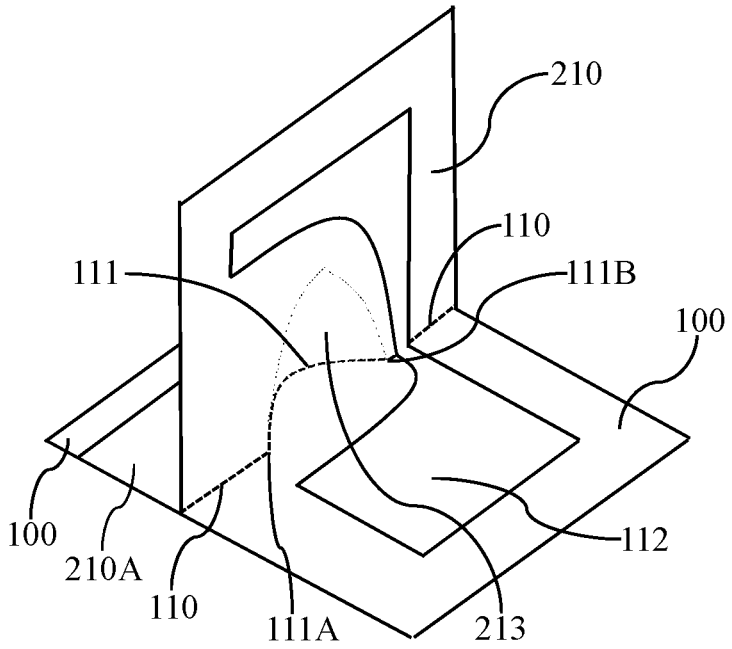
FIG. 13 is a schematic perspective view of another example of the structure shown in FIG. 11.
Figure 14:
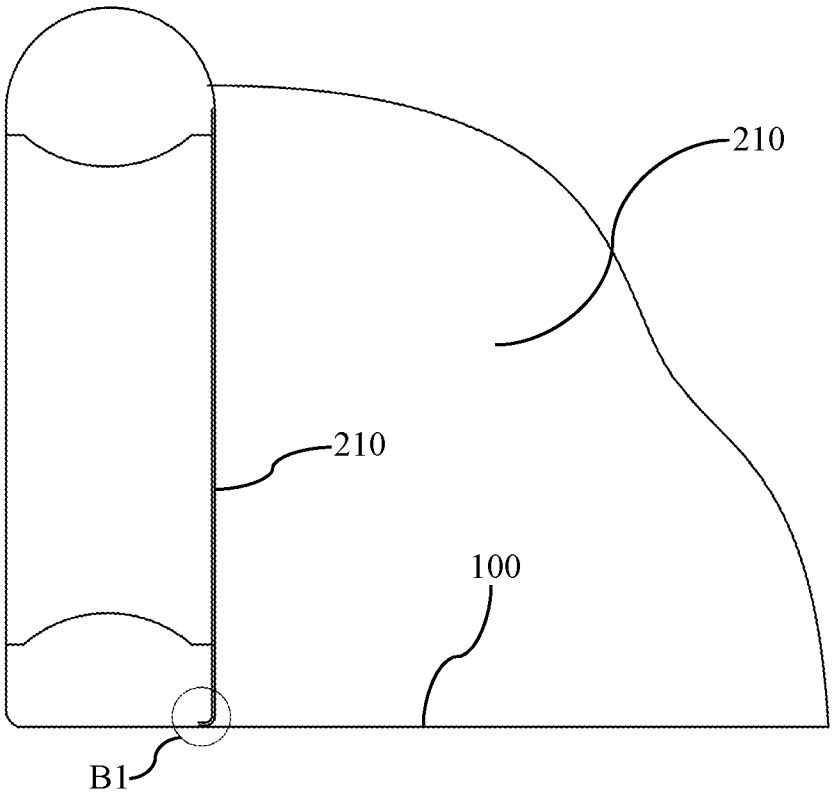
FIG. 14 is a partial cross-sectional view of an inflatable pool showing an arched weld segment including two inner wall splice sheets and a bottom wall, according to an example embodiment.
Figure 15:
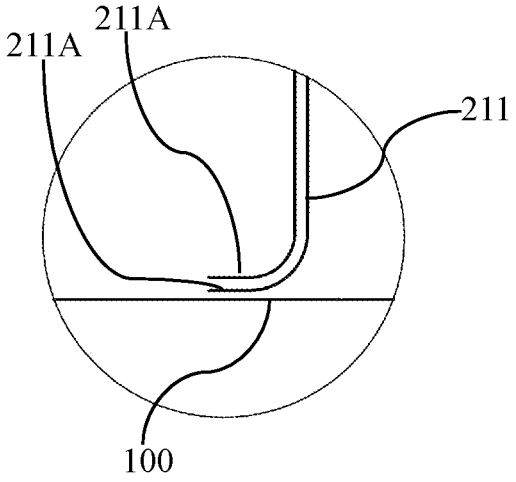
FIG. 15 is an enlarged schematic view of the area indicated by B1 in FIG. 14.
Figure 16:
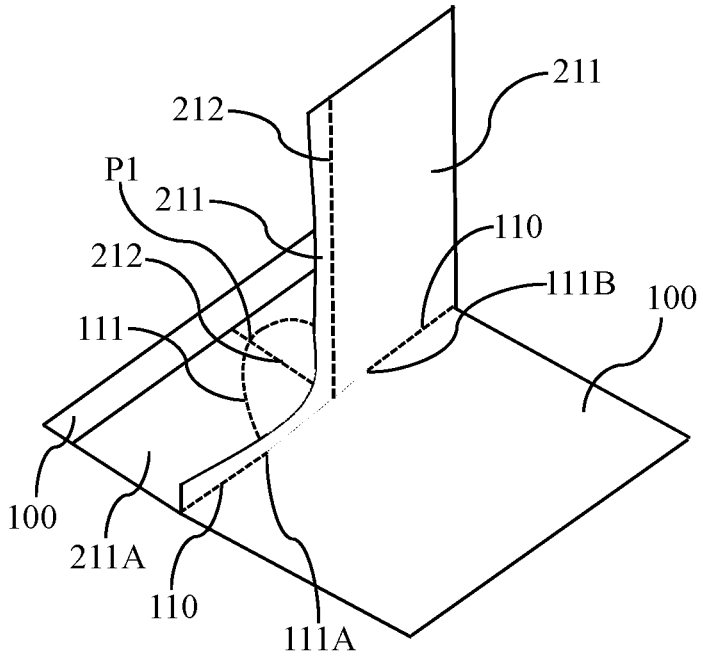
FIG. 16 is a schematic perspective view of an example of the structure shown in FIG. 15.
Figure 17:
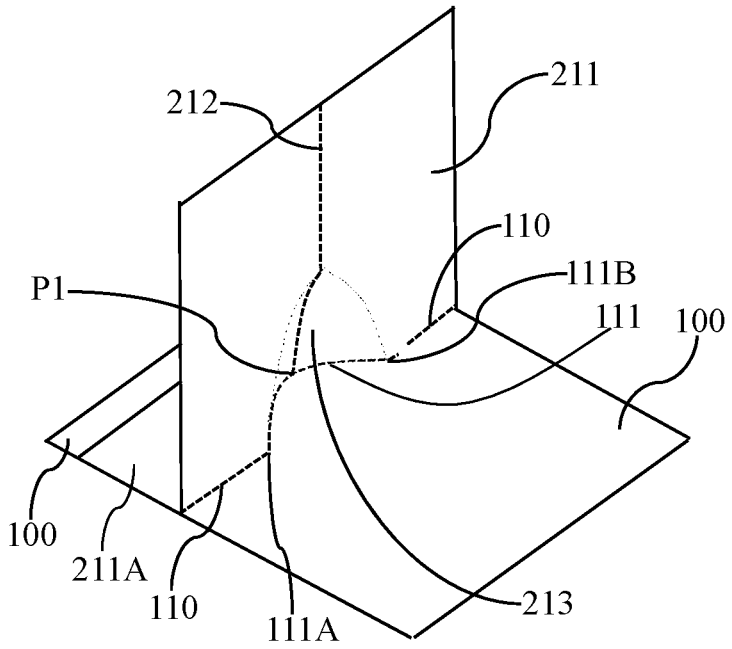
FIG. 17 is a schematic perspective view of another example of the structure shown in FIG. 15.
Figure 18:
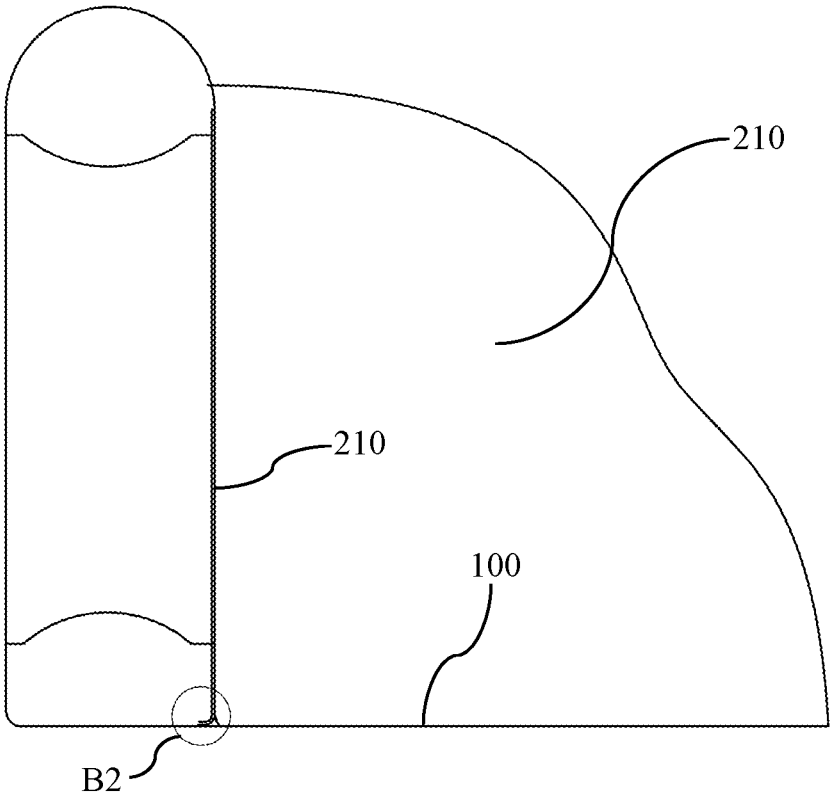
FIG. 18 is a partial cross-sectional view similar to FIG. 14, showing n addition of a reinforcing strip according to an example embodiment.
Figure 19:
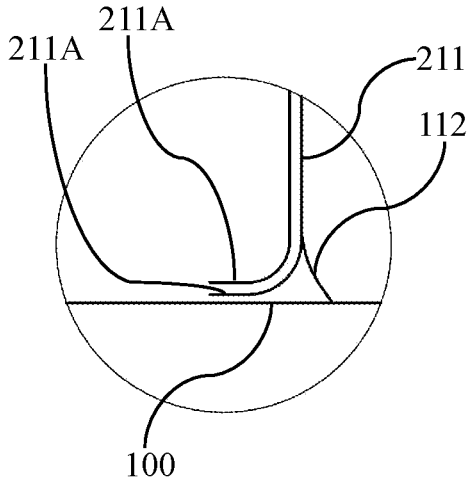
FIG. 19 is an enlarged schematic view of the area indicated by B2 in FIG. 18.
Figure 20:
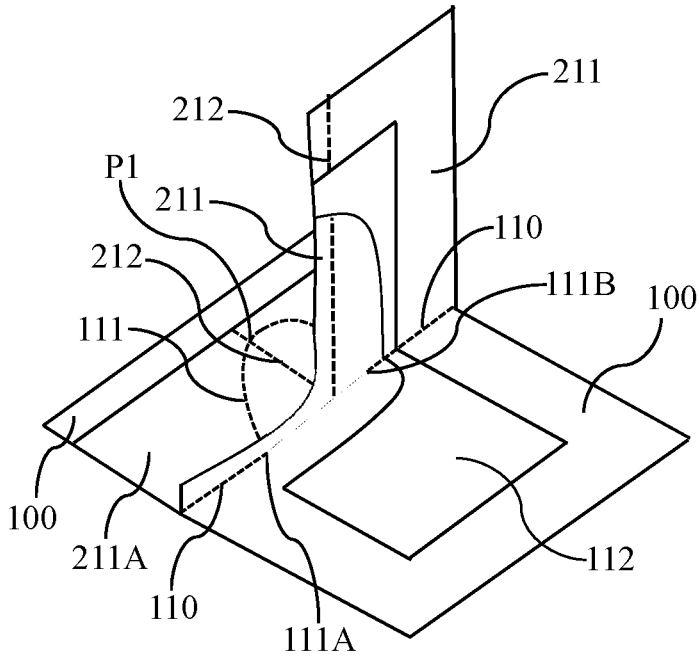
FIG. 20 is a schematic perspective view of an example of the structure shown in FIG. 19.
Figure 21:
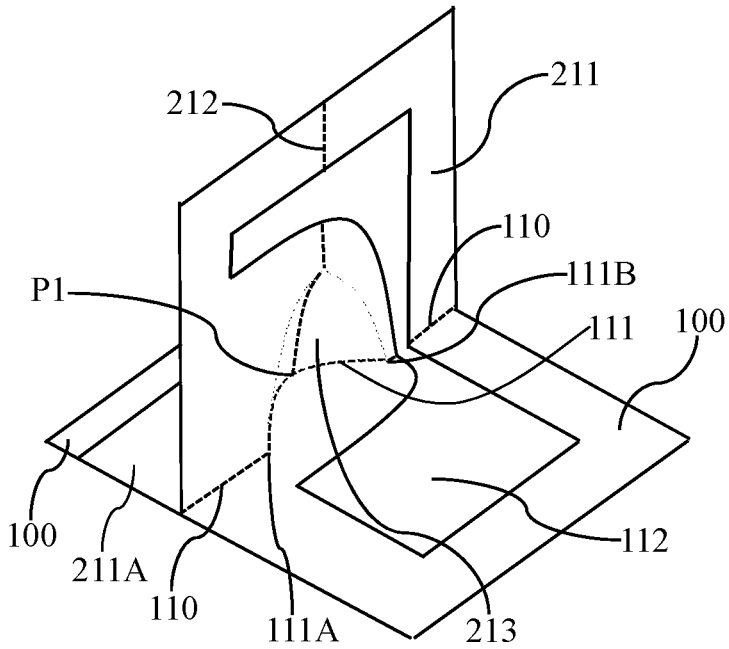
FIG. 21 is a schematic perspective view of another example of the structure shown in FIG. 19.
Figure 22:
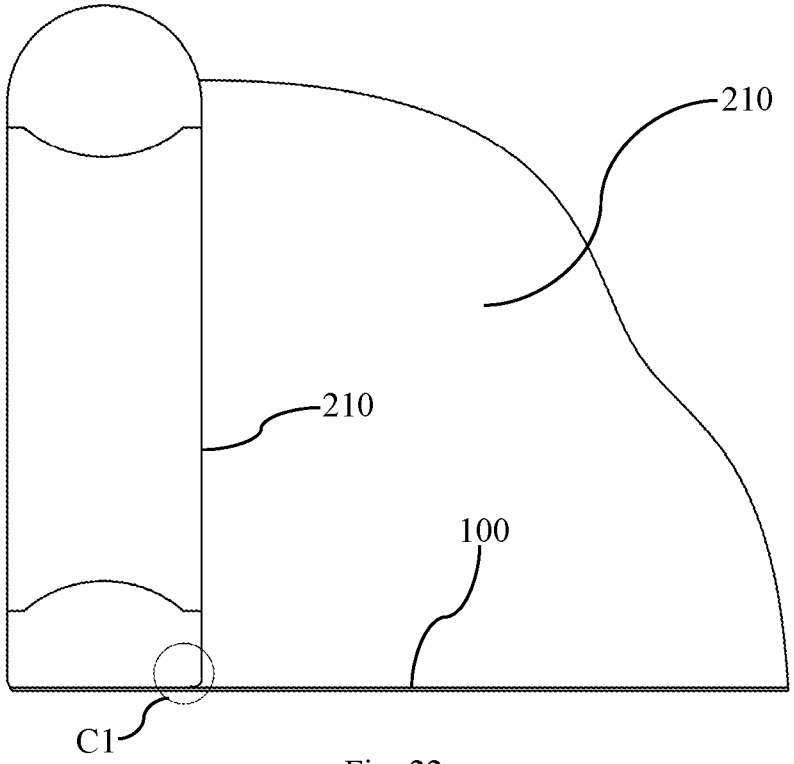
FIG. 22 is a partial cross-sectional view of an inflatable pool showing an arched weld segment including one inner side wall piece and two bottom splice sheets, according to an example embodiment.
Figure 23:
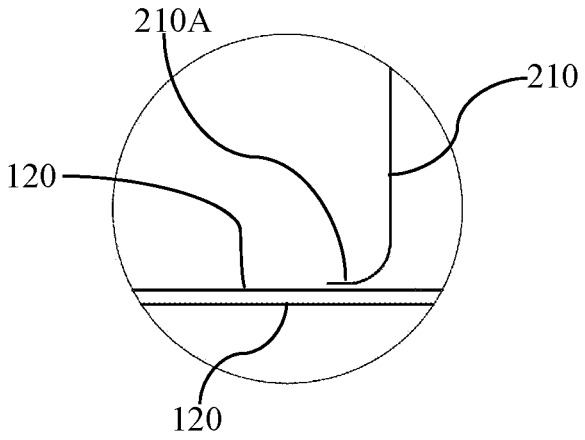
FIG. 23 is an enlarged schematic view of the area indicated by C1 in FIG. 22.
Figure 24:
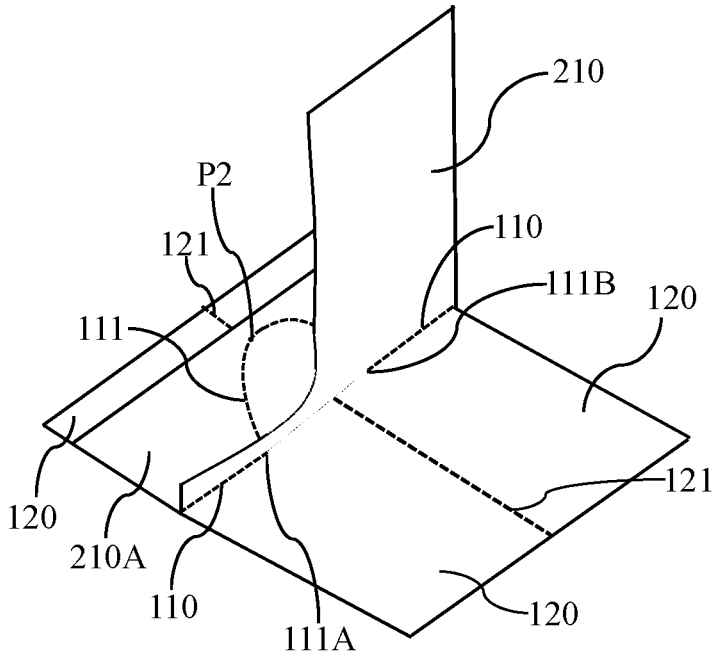
FIG. 24 is a schematic perspective view of an example of the structure shown in FIG. 23.
Figure 25:
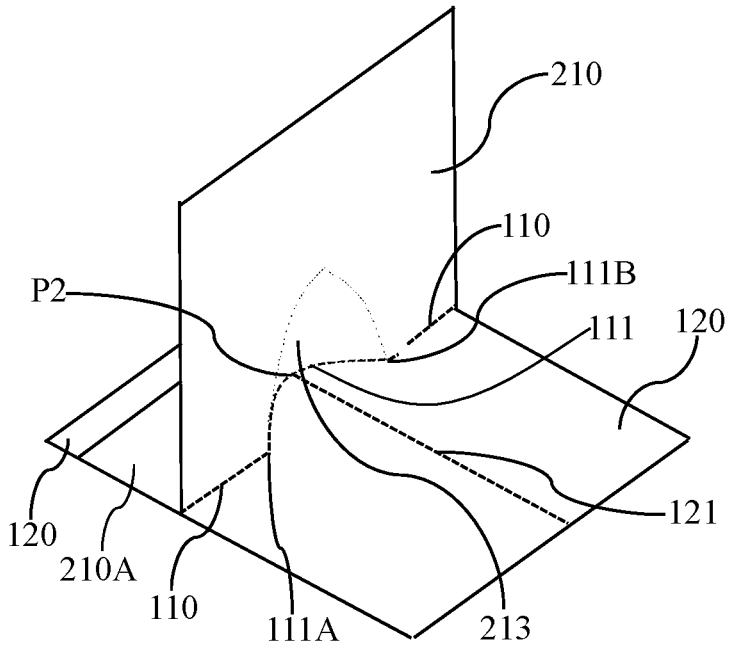
FIG. 25 is a schematic perspective view of another example of the structure shown in FIG. 23.
Figure 26:
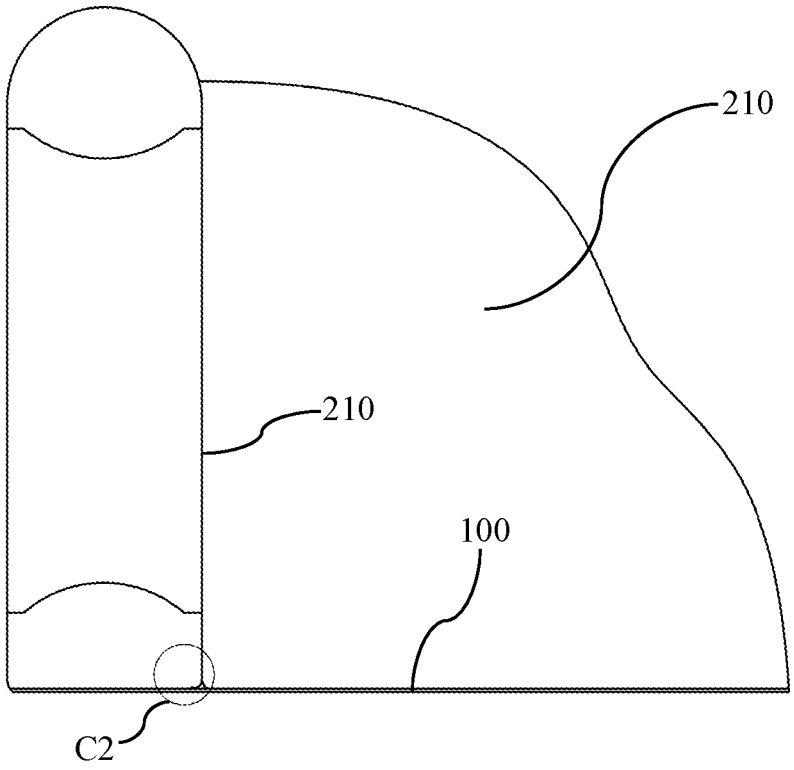
FIG. 26 is a partial cross-sectional view similar to FIG. 22, showing an addition of a reinforcing strip according to an example embodiment.
Figure 27:
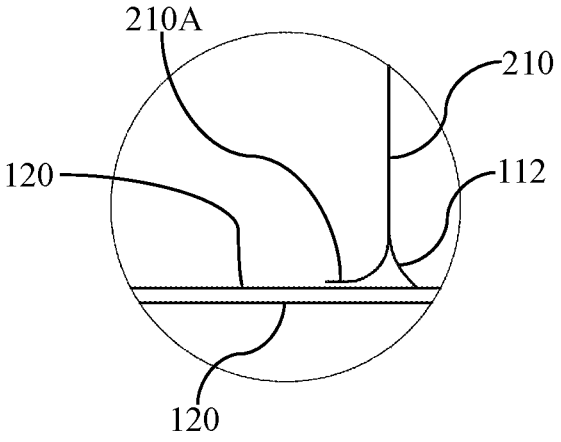
FIG. 27 is an enlarged schematic view of the area indicated by C2 in FIG. 26.
Figure 28:
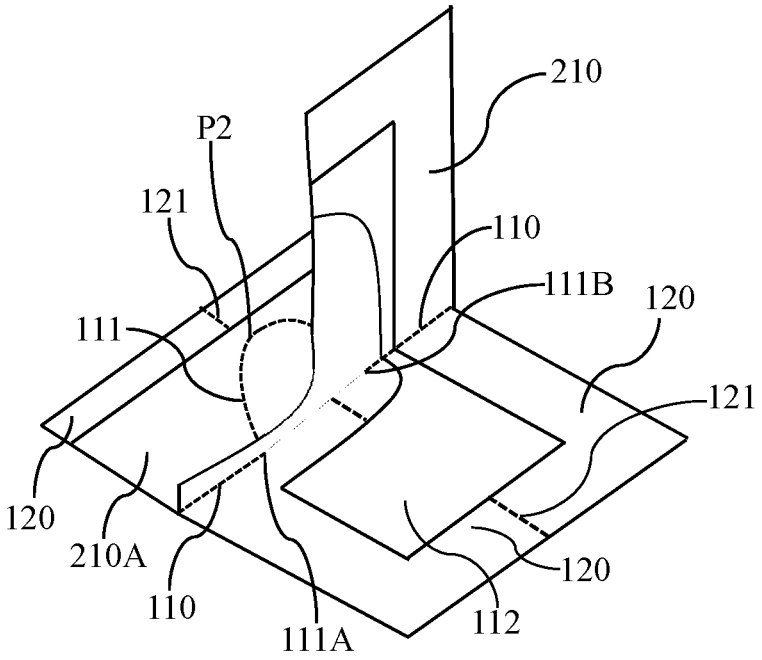
FIG. 28 is a schematic perspective view of an example of the structure shown in FIG. 27.
Figure 29:
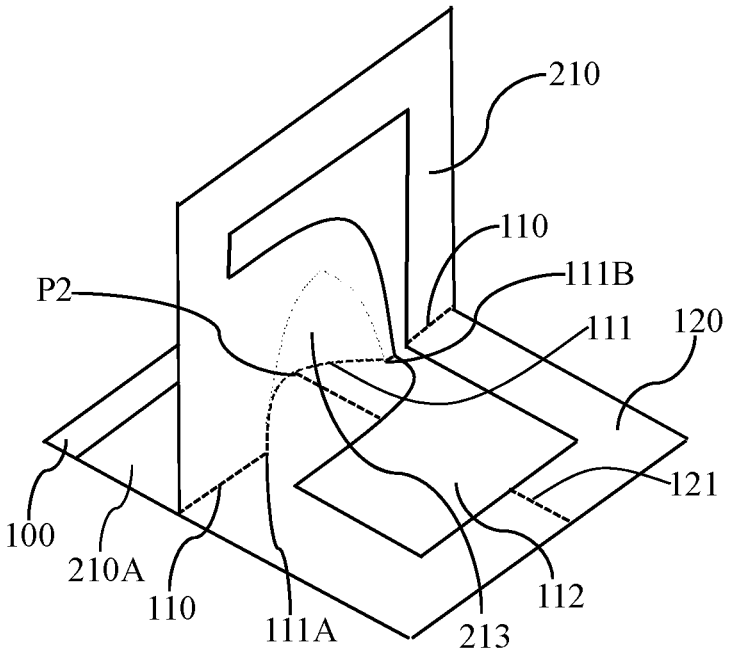
FIG. 29 is a schematic perspective view of another example of the structure shown in FIG. 27.

The arched weld segment 111 may be implemented at a position on the connection structure that is prone to tearing, such as a stress concentration point or a complex weld position. The arched weld segment 111 projects toward the outer side wall 220 with respect to other positions of the annular weld 110, and the inner side wall 210 and the bottom wall 100 are not connected and at most are in contact with each other on a straight line connecting two ends 111A and 111B of the arched weld segment 111. As exemplarily shown in FIGS. 6 and 7, in the straight line between 111A and 111B in FIG. 6, the inner side wall 210 and the bottom wall 100 are not connected but in contact with each other, while in the straight line between 111A and 111B in FIG. 7, the inner side wall 210 and the bottom wall 100 are separated without contact, that is, the inner side wall 210 forms a groove 213 at and near the arched weld segment 111. FIGS. 8 and 9 respectively illustrate an example implementation of the formation of the structure at the arched weld segment 111 of FIG. 6. A copper mold 400 surrounds the outside of the inner side wall 210 and a perimeter of the copper mold 400 is approximately equal to that of the inner side wall 210. The inner side wall 210 is flattened along an inside surface of the copper mold 400 and abuts against the inside surface of the copper mold 400. The lower edge 210A of the inner side wall 210 is folded outward and overlaps on an upper edge of the copper mold 400, and then, the bottom wall 100 is placed over the entire lower edge 210A. A welding base plate of a welder is pressed against the upper edge of the copper mold 400. The portions of the inner side wall 210 and the bottom wall 100 sandwiched between the welding base plate and the upper edge of the copper mold 400 are welded, thus forming the annular weld 110 along the track of the upper edge of the copper mold 400. As the upper edge of the copper mold 400 has outwardly projecting protrusions 410, the arched weld segments 111 of the annular weld 110 are formed accordingly. The protrusions 410 shown in FIG. 8 are formed on and near the upper edge of the copper mold 400. According to one or more example embodiments, as shown in FIG. 9, the protrusions 410 extend along the z-direction from the lower edge of the copper mold 400 to the upper edge of the copper mold 400.

Referring to the example embodiments shown in FIGS. 10 to 13, on the basis of the above-described example embodiments shown in FIGS. 4 to 7, in order to strengthen the connection between the inner side wall 210 and the bottom wall 100 and further reduce the stress at the arched weld segment 111, a reinforcing strip 112 may be provided at the arched weld segment 111. The reinforcing strip 112 connects the inner side wall 210 and the bottom wall 100 and helps to bear the pressure exerted by the water in the water cavity 300 on the arched weld segment 111. Alternatively, the reinforcing strip 112 may completely cover the arched weld segment 111, isolating the arched weld segment 111 from the water in the water cavity 300, and protecting the arched weld segment 111 from the direct hydrostatic pressure. The reinforcing strip 112 can be attached to the inner side wall 210 and the bottom wall 100 by bonding, welding, or other methods. It should be understood that, in some alternative embodiments, the reinforcing strip 112 may be annular and cover the entire annular weld 110, isolating the annular weld 110 from the water in the water cavity 300.

According to one or more example embodiments, referring to FIGS. 14 to 17, the inner side wall 210 is formed by joining at least one inner wall splice sheet 211 end-to-end, that is, the inner side wall 210 may be formed by joining one inner wall splice sheet 211 end-to-end to create a cylindrical shape or by adjoining at least two or more inner wall splice sheets 211 together to form a single sheet of material, which is then joined end-to-end to create a cylindrical shape. The lower edges 211A of the respective inner wall splice sheets 211 are also joined end-to-end so as to integrally form the lower edge 210A of the inner side wall. The joining method may be welding. A first weld 212 is formed at the joint between adjacent inner wall splice sheets 211 or end-to-end joint of the inner wall splice sheets. When the lower edge 211A of the inner wall splice sheet 211 is welded to the bottom wall 100 to form the annular weld 110, the first weld 212 may intersect the arched weld segment 111. Thus, the intersection of the first weld 212 and the arched weld segment 111 forms a triple-layer weld point, referred to herein as a first multi-layer weld point P1, where two layers of the inner wall splice sheets 211 and one layer of the bottom wall 100 are stacked together. The stress at the arched weld segment 111 is smaller than at other positions of the annular weld 110, thus reducing the risk of tearing. This overcomes the technical problem that is it is a straight weld segment at the position that the first weld intersects the annular weld, the connection between the inner side wall and the bottom wall at the position is weak and easily torn due to two layers of the inner side wall overlapping at the first weld.

Likewise, referring to the example embodiments shown in FIGS. 18 to 21, with reference to the above-described embodiments shown in FIGS. 14 to 17, in order to strengthen the connection between the inner side wall 210 and the bottom wall 100 and further reduce the stress at the arched weld segment 111, a reinforcing strip 112 may be provided at the arched weld segment 111. The reinforcing strip 112 connects the inner side wall 210 and the bottom wall 100 and helps to bear the pressure exerted by the water in the water cavity 300 on the arched weld segment 111. Alternatively, the reinforcing strip 112 may completely cover the arched weld segment 111, isolating the arched weld segment 111 from the water in the water cavity 300, and protecting the arched weld segment 111 from the direct hydrostatic pressure. The reinforcing strip 112 can be attached to the inner side wall 210 and the bottom wall 100 by bonding, welding, or other methods. It should be understood that, in some example embodiments, the reinforcing strip 112 is annular and covers the entire annular weld 110, isolating the annular weld 110 from the water in the water cavity 300.

According to one or more example embodiments, referring to the example embodiments shown in FIGS. 2 and 22 to 25, the bottom wall 100 is formed by joining at least two bottom splice sheets 120, and thus at least one second weld 121 is formed. The joining method may be welding. When the lower edge 210A of the inner side wall 210 is welded to the bottom wall 100 to form the annular weld 110, the second weld 121 may intersect with the arched weld segment 111. FIG. 2 shows an example the overlap of the second weld 121 with the arched weld segment 111, with two ends of the second weld 121 reaching the weld line between the bottom wall 100 and the outer side wall 220. Thus, the intersection of the second weld 121 and the arched weld segment 111 forms a triple-layer weld point, referred to herein as a second multi-layer weld point P2, where one layer of the inner side wall 210 (or the inner side wall splice sheet 211) and two layers of the bottom splice sheets 120 are stacked together. The stress on the annular weld 110 at the arched weld segment 111 is smaller than at other positions on the annular weld 110, thus reducing the risk of tearing. This may aid in addressing the technical problem that if it is a straight weld segment at the position in that the second weld intersects the annular weld, the connection between the inner side wall and the bottom wall at the position is weak and easily torn due to two layers of the bottom wall overlapping at the second weld.

Likewise, referring to the example embodiments shown in FIGS. 26 to 29, and the above-described example embodiments shown in FIGS. 22 to 25, in order to strengthen the connection between the inner side wall 210 and the bottom wall 100 and further reduce the stress at the arched weld segment 111, a reinforcing strip 112 may be provided at the arched weld segment 111. The reinforcing strip 112 connects the inner side wall 210 and the bottom wall 100 and helps to bear the pressure exerted by the water in the water cavity 300 on the arched weld segment 111. Alternatively, the reinforcing strip 112 may completely cover the arched weld segment 111, isolating the arched weld segment 111 from the water in the water cavity 300, and protecting the arched weld segment 111 from the direct hydrostatic pressure. The reinforcing strip 112 can be attached to the inner side wall 210 and the bottom wall 100 by bonding, welding, or other methods. It should be understood that, in some example embodiments, the reinforcing strip 112 may be annular and cover the entire annular weld 110, isolating the annular weld 110 from the water in the water cavity 300.

It should be understood that, according to one or more example embodiments, when the first and second multi-layer weld points are close to each other, an arched weld segment 111 may be provided to span the first and second multi-layer weld points that are close to each other to simultaneously solve the tearing problem caused by the two multi-layer weld points. According to one or more example embodiments, the first and second multi-layer weld points overlap each other to form a four-layer weld point (not shown), and the arched weld segment 111 may also be provided at the four-layer weld point to reduce the risk of tearing at these weld points.

Figure 30:
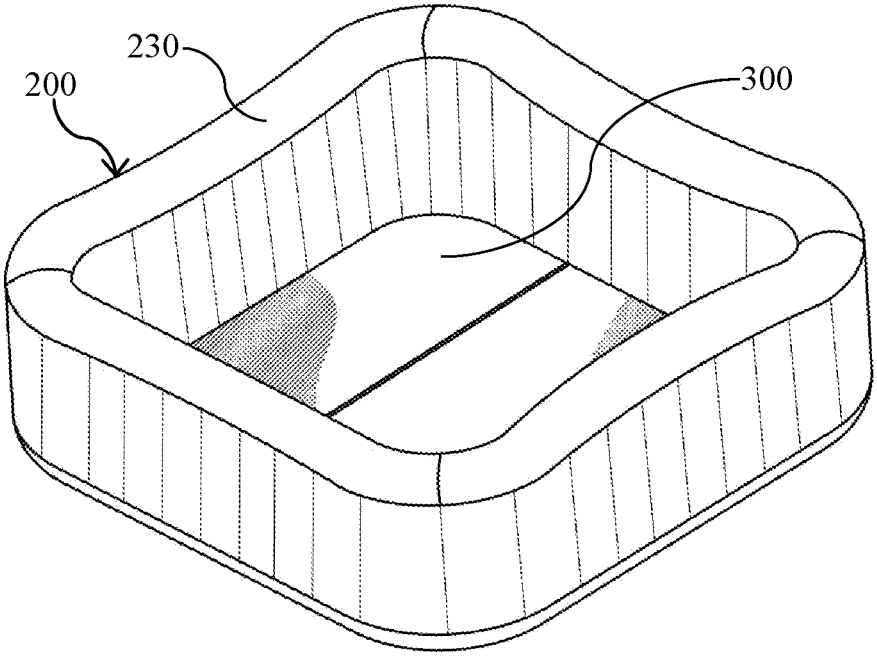
FIG. 30 is a schematic perspective view of another example embodiment of an inflatable pool.
Figure 31:
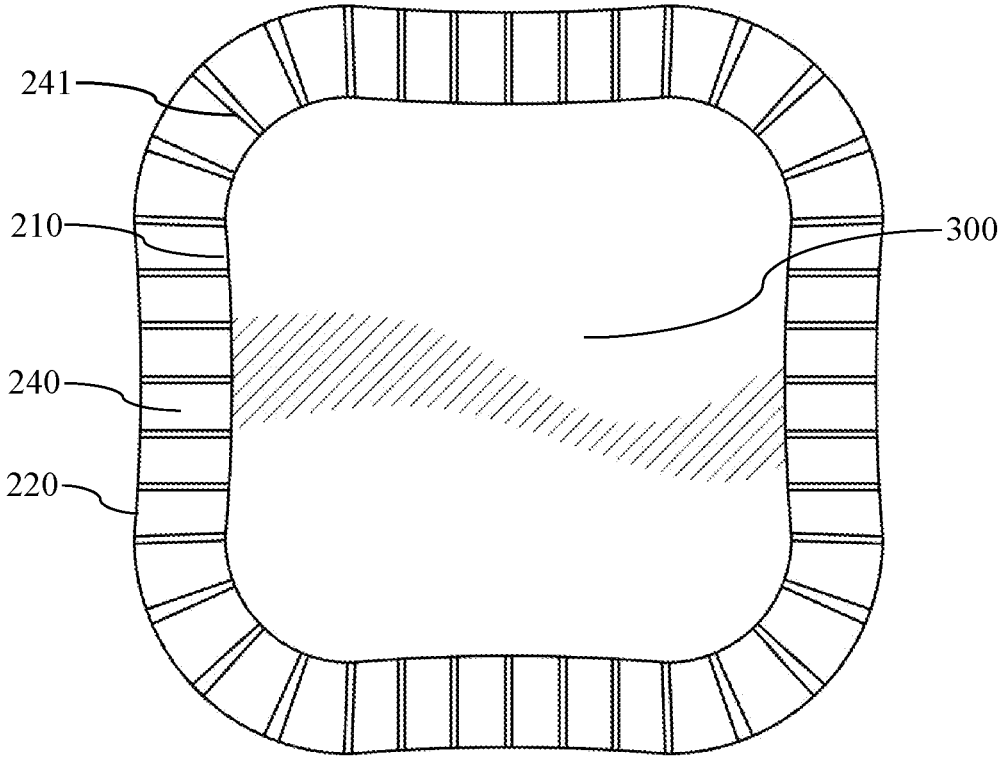
FIG. 31 is a cross-sectional view of an inflatable chamber shown in FIG. 30.
Figure 32:
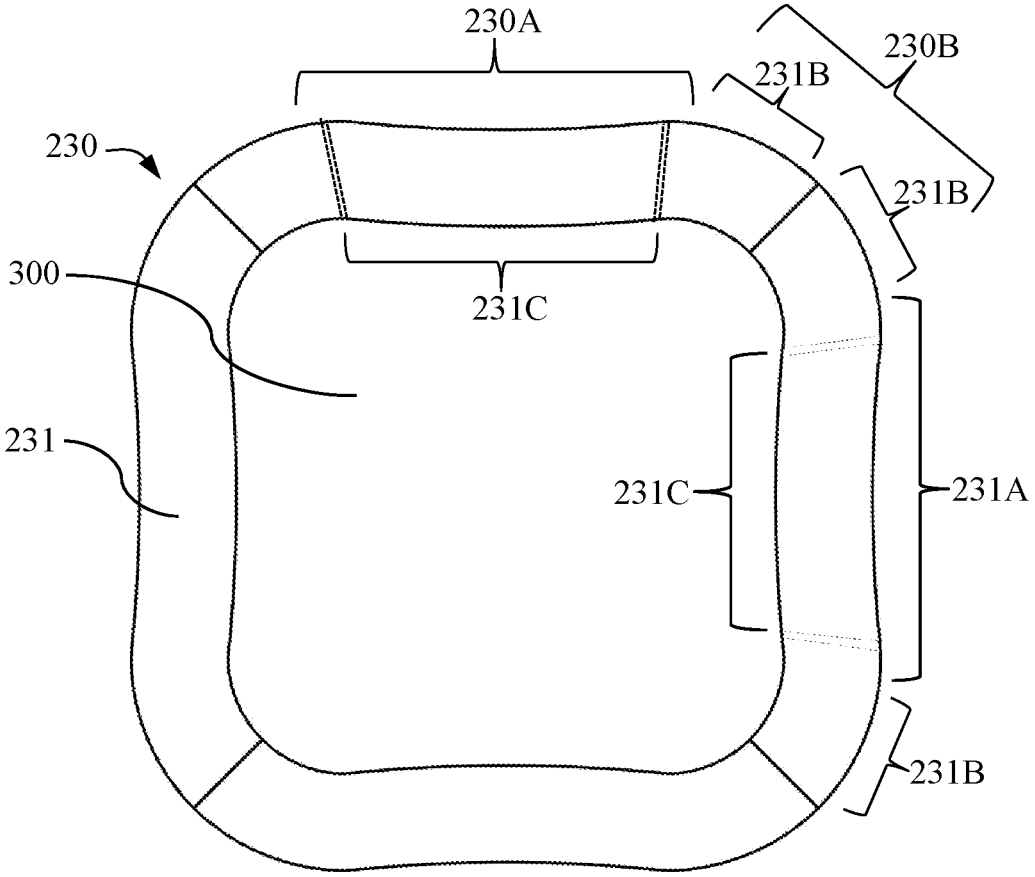
FIG. 32 is a schematic top view of a top wall of the inflatable pool shown in FIG. 30.

According to one or more example embodiments, referring to FIGS. 30 to 32, the top wall 230 is annular and includes side bodies 230A and corner portions 230B, each side body 230A having an arcuate segment 231C curved toward the inside of the water cavity 300. With continued reference to FIGS. 30 to 32, the top wall 230 is formed by joining four top splice sheets 231 end-to-end to create the top wall 230. The joining method may be welding. Each individual top splice sheet 231 is composed of a main body section 231A and two side sections 231B at opposite ends of the main body section 231A. The top splice sheets 231 are connected to each other in an annular shape by joining the side sections 231B of adjacent top splice sheets 231. The main body section 231A of the top splice sheet 231 forms the side body 230A of the top wall 230, and the side section 231B of one top splice sheet 231 and the side section 231B of another adjacent top splice sheet 231 are welded to each other to form the corner portion 230B of the top wall 230. Each top splice sheet 231 has an arcuate segment 231C curved toward the inside of the water cavity 300. As shown in FIG. 32, the side body 230A/main body section 231A has an arcuate segment 231C curved toward the inside of the water cavity 300. For clarity, the general area of the arcuate segment 231C is indicated by a pair of double dashed lines in FIG. 32. However, in reality, the double dashed lines do not exist. The side body 230A/main body section 231A features an arcuate segment 231C curved toward the water cavity, which can increase the support force toward the water cavity 300 for the inner side wall 210 and the outer side wall 220 to resist the hydrostatic pressure in the water cavity 300. It should be understood that the arcuate segment 231C may be a part of the side body 230A/main body section 231A or may be the entire side body 230A/main body section 231A. According to one or more example embodiments, referring to FIG. 32, all of the top splice sheets 231 of the top wall 230 may include the arcuate segment 231C curved toward the inside of the water cavity 300. According to other example embodiments, the main body section 231A of only some of the top splice sheets 231 may include the arcuate segment 231C curved toward the inside of the water cavity 300. The inflatable pool shown in FIGS. 30 to 32 is substantially quadrilateral and has four top splice sheets 231. It should also be understood that the shape of the inflatable pool is not limited thereto and may be any of elliptical, hexagonal, octagonal, etc. Correspondingly, a number of the top splice sheets 231 may be adjusted accordingly. For example, the top wall of an elliptical inflatable pool may include two semi-elliptical top splice sheets joined together, the top wall of a hexagonal inflatable pool may include six top splice sheets joined together, and the top wall of an octagonal inflatable pool may include eight top splice sheets joined together. It should also be understood that, in some example embodiments, the top wall 230 may be one-piece, i.e., may be made of a single annular piece of material instead of being constructed by joining multiple splice sheets.

Referring to FIGS. 3 and 31, tensioning members 241 are provided within the inflatable chamber 240. The tensioning members 241 are connected to the inner side wall 210 and the outer side wall 220, using methods such as bonding or welding, to aid in shaping during inflation of the inflatable chamber 240 and to enhance the overall structural strength of the inflatable pool while forming decorative patterns on the visible surface of the inflatable pool.

Figure 33:
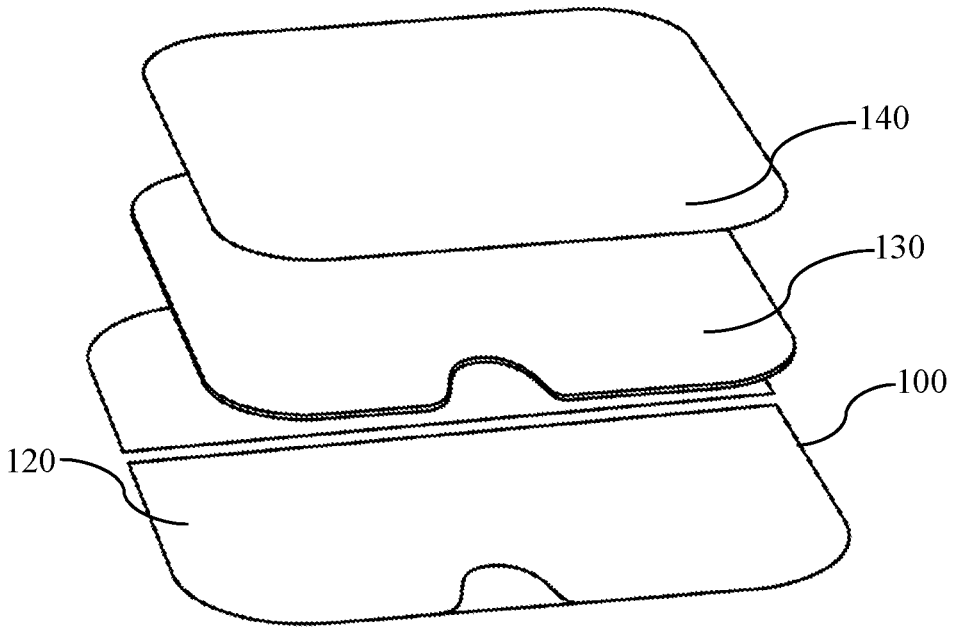
FIG. 33 is an exploded schematic view of an example of a bottom wall.

According to one or more example embodiments, referring to FIG. 33, the inflatable pool further includes a cushion layer 130 and a mat layer 140. The periphery of the mat layer 140 is connected to the bottom wall 100, such as by bonding or welding. The cushion layer 130 is sandwiched between the mat layer 140 and the bottom wall 100 to provide a comfortable stepping feel and to act as thermal insulation. The cushion layer 130 may be made of one or more materials including expanded polyethylene foam, polyester fiberfill, etc. As shown in FIG. 33, for example, the bottom wall 100 may be formed by joining two bottom splice sheets 120.

It should be understood that any one or more of the inner side wall 210, the outer side wall 220, the top wall 230, and the bottom wall 100 may be made of weldable materials such as PVC (thermoplastic polyvinyl chloride), TPU (thermoplastic polyurethane), and may be bonded or welded to each other. The reinforcing strip 112 and the tensioning member 241 may also be made of a weldable material such as PVC or TPU, and may also be bonded or welded to the bottom wall 100, the inner side wall 210, and the outer side wall 220.

It should be understood that the joining methods described herein may all be welding.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable pool, comprising:
a top wall;
a bottom wall;
an inner side wall comprising:
a first end:
a second end welded to the first end of the inner side wall to form a first weld;
a lower edge welded to the bottom wall to form an annular weld and define a water cavity; and
an outer side wall surrounding the inner side wall;
wherein the annular weld comprises at least one arched weld segment projecting toward the outer side wall and the arched weld segment intersects the first weld.

2. The inflatable pool according to claim 1, wherein the bottom wall comprises a first bottom splice sheet welded to a second bottom splice sheet, thereby forming a second weld, the second weld which intersects the arched weld segment.

3. The inflatable pool according to claim 1, further comprising a reinforcing strip disposed at the arched weld segment and connecting the inner side wall and the bottom wall.

4. The inflatable pool according to claim 3, wherein the reinforcing strip completely covers the arched weld segment and is attached to each of the inner side wall and the bottom wall.

5. The inflatable pool according to claim 1, wherein the top wall is annular and comprises an arcuate segment curved toward an inside of the water cavity.

6. The inflatable pool according to claim 5, wherein the top wall comprises at least two top splice sheets joined end-to-end, each of the at least two splice sheets forming an arcuate segment.

7. The inflatable pool according to claim 1, wherein an inflatable chamber is jointly defined by the inner side wall, the outer side wall, the top wall, and the bottom wall, wherein the inflatable pool further comprises a plurality of tensioning members are disposed within the inflatable chamber, wherein each of the plurality of tensioning members is connected to the inner side wall and the outer side wall.

8. The inflatable pool according to claim 1, further comprising:
a cushion layer, and
a mat layer, wherein a periphery of the mat layer is connected to the bottom wall, and the cushion layer is sandwiched between the mat layer and the bottom wall.

9. The inflatable pool according to claim 8, wherein the cushion layer is made of one of expanded polyethylene foam and polyester fiberfill.

10. An inflatable pool comprising:
a bottom wall comprising a first bottom splice sheet and a second bottom splice sheet welded to the first splice sheet to form a first weld;
an inner side wall comprising a lower edge welded to the bottom wall to form a second weld, the second weld comprising:
a first arched weld segment projecting outwardly and intersecting the first weld at a first position, and
a second arched weld segment projecting outwardly and intersecting the first weld at a second position,
an outer side wall surrounding the inner side wall,
an annular top wall; and,
an inflatable chamber defined by the annular top wall, the bottom wall, the inner side wall and the outer side wall.

11. The inflatable pool according to claim 10, further comprising:
a plurality of tensioning members disposed within the inflatable chamber, wherein each of the plurality of tensioning members has a first side connected to the inner side wall and a second side connected to the outer side wall.

12. The inflatable pool according to claim 10, further comprising:
a first reinforcing strip connecting the inner side wall and the bottom wall at the first arched weld segment, and
a second reinforcing strip connecting the inner side wall and the bottom wall at the second arched weld segment.

13. The inflatable pool according to claim 10, wherein the inner side wall comprises:
a first inner wall splice sheet and a second inner wall splice sheet;
wherein a first end of the first inner wall splice sheet is welded to a second end of the second inner wall splice sheet, thereby forming a first side wall weld which intersects the first arched weld segment; and
wherein a second end of the first inner wall splice sheet is welded to a first end of the second inner wall splice sheet, thereby forming a second side wall weld which intersects the second arched weld segment.

14. The inflatable pool according to claim 10, further comprising:
a mat layer, wherein a periphery of the mat layer is welded to the bottom wall; and
a cushion layer disposed between the mat layer and the bottom wall.

15. The inflatable pool according to claim 14, wherein the cushion is made of one of expanded polyethylene foam and polyester fiberfill.

16. An inflatable pool, comprising:
a top wall;
a bottom wall comprising a first bottom splice sheet and a second bottom splice sheet welded to the first bottom splice sheet to form a second weld;
an inner side wall comprising a lower edge welded to the bottom wall to form an annular weld and define a water cavity;
an outer side wall surrounding the inner side wall;
wherein the annular weld comprises at least one arched weld segment projecting toward the outer side wall and the arched weld segment intersects the second weld of the bottom wall.

17. An inflatable pool, comprising:

an annular top wall;

a bottom wall, an inner side wall comprising a lower edge welded to the bottom wall to form an annular weld and define a water cavity;

an outer side wall surrounding the inner side wall;

wherein the annular top wall comprises an arcuate segment curved toward an inside of the water cavity.

18. The inflatable pool according to claim 17, wherein the annular top wall comprises at least two top splice sheets joined end-to-end, each of the at least two splice sheets forming an arcuate segment.

* * * * *